US010900483B2

(12) United States Patent
Stachowiak, Jr.

(10) Patent No.: US 10,900,483 B2
(45) Date of Patent: Jan. 26, 2021

(54) WIPER RING ASSEMBLY WITH ENERGIZING MEMBER

(71) Applicant: Weatherford Technology Holdings, LLC, Houston, TX (US)

(72) Inventor: John E. Stachowiak, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 49 days.

(21) Appl. No.: 16/026,296

(22) Filed: Jul. 3, 2018

(65) Prior Publication Data

US 2020/0011327 A1 Jan. 9, 2020

(51) Int. Cl.

| | |
|---|---|
| ***F04C 13/00*** | (2006.01) |
| ***E21B 43/12*** | (2006.01) |
| ***E21B 33/08*** | (2006.01) |
| ***F04B 47/02*** | (2006.01) |
| ***E21B 17/10*** | (2006.01) |
| ***F04B 53/16*** | (2006.01) |
| ***E21B 7/04*** | (2006.01) |
| ***E21B 19/16*** | (2006.01) |
| ***E21B 19/08*** | (2006.01) |
| ***E21B 19/14*** | (2006.01) |

(52) U.S. Cl.

CPC ..... *F04C 13/008* (2013.01); *E21B 43/126* (2013.01); *E21B 17/1071* (2013.01); *E21B 33/08* (2013.01); *E21B 43/127* (2013.01); *F04B 47/02* (2013.01); *F04B 53/16* (2013.01)

(58) Field of Classification Search

CPC . E21B 7/04; E21B 19/16; E21B 19/08; E21B 19/14; E21B 7/043; E21B 19/163; E21B 19/164

USPC ..... 417/554

See application file for complete search history.

(56) References Cited

U.S. PATENT DOCUMENTS 2,565,923 A 8/1951 Hrdlicka, Jr.
3,947,158 A * 3/1976 Gage ..... F04B 53/126 417/554

(Continued)

OTHER PUBLICATIONS

Black Gold Pump & Supply, Inc.; "Plungers"; copyright 2018; obtained from http://blackgoldpump.com/Components/Plungers/tabid/104/Default.aspx; downloaded May 23, 2018; 3-pgs.

(Continued)

*Primary Examiner* — Tara Schimpf
*Assistant Examiner* — Manuel C Portocarrero
(74) *Attorney, Agent, or Firm* — Blank Rome LLP

(57) ABSTRACT

A downhole pump is used for a reciprocating pump system having a rod string disposed in a tubing string. A barrel of the pump is disposed, and a plunger of the pump coupled to the rod string is movably disposed in the barrel. The plunger has an external surface disposed at an annular gap relative to the barrel's internal surface. The external surface has circumferential grooves defined thereabout that hold wipers. An inner ring of the wipers composed of a swellable material is engaged in the one or more circumferential grooves, while an outer ring composed of a second material is disposed about the inner ring. The swellable material of the inner ring energizes the outer ring in slideable engagement with the internal surface of the barrel.

19 Claims, 3 Drawing Sheets

(56) References Cited

U.S. PATENT DOCUMENTS

| | | | | |
|---|---|---|---|---|
| 6,176,331 | B1 * | 1/2001 | Jin | E21B 10/25 175/372 |
| 8,858,187 | B2 | 10/2014 | Lane | |
| 9,482,227 | B2 | 11/2016 | Stachowiak, Jr. | |
| 2008/0303218 | A1 | 12/2008 | van Schoor et al. | |
| 2011/0248450 | A1 | 10/2011 | van Schoor et al. | |
| 2013/0039780 | A1 * | 2/2013 | Lane | F04B 47/02 417/53 |
| 2015/0136384 | A1 | 5/2015 | Stachowiak, Jr. | |
| 2018/0156006 | A1 * | 6/2018 | Wright | E21B 33/1208 |

OTHER PUBLICATIONS

Darcova, Inc.; "Yellowjackets & Composition Rings"; revised May 12, 2017; 4-pgs.
Dover Artificial Lift, "Harbison-Fischer Sand Flush Plunger(TM)"; copyright 2017; 1-pg.
Harbison-Fischer; "Sand Pro(TM) Pump"; undated, obtained from http://www.doverals.com on May 23, 2017; 8-pgs.
Harbison-Fischer; "Variable Slippage Pump(TM)", undated, obtained from http://www.doverals.com on May 23, 2017; 8-pgs.
Utex Industries, Inc.; "Plunger Packing"; undated, obtained from http://www.utexind.com/wp-content/uploads/brochures/PlungerPacking.pdf on May 23, 2017; 14-pgs.
Weatherford, Inc.; "Sand-Tolerant Pump"; copyright 2015, 6-pgs.
Office Action in counterpart Canadian Appl. 3047003, dated Aug. 25, 2020, 6-pgs.

* cited by examiner

WIPER RING ASSEMBLY WITH ENERGIZING MEMBER

BACKGROUND OF THE DISCLOSURE

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation and inhibits the unassisted flow of production fluid to the surface.

A common approach for urging production fluids to the surface uses a mechanically actuated, positive displacement pump. Reciprocal movement of a string of sucker rods induces reciprocal movement of the pump for lifting production fluid to the surface. For example, a reciprocating rod lift system 20 of the prior art is shown in FIG. 1 to produce production fluid from a wellbore 10. As is typical, surface casing 12 hangs from the surface and has a liner casing 14 hung therefrom by a liner hanger 16. Production fluid F from the formation 19 outside the cement 18 can enter the liner 14 through perforations 15. To convey the fluid, production tubing 30 extends from a wellhead 32 downhole, and a packer 36 seals the annulus between the production tubing 30 and the liner 14. At the surface, the wellhead 32 receives production fluid and diverts it to a flow line 34.

The production fluid F may not produce naturally to reach the surface so operators use the reciprocating rod lift system 20 to lift the fluid F. The system 20 has a surface pumping unit 22, a rod string 24, and a downhole rod pump 50. The surface pumping unit 22 reciprocates the rod string 24, and the reciprocating string 24 operates the downhole rod pump 50. The rod pump 50 has internal components attached to the rod string 24 and has external components positioned in a pump-seating nipple 38 near the producing zone and the perforations 15.

As shown briefly in FIG. 1, the rod pump 50 has a barrel 60 with a plunger 80 movably disposed therein. The barrel 60 has a standing valve 70, and the plunger 80 is attached to the rod string 24 and has a traveling valve 90. For example, the traveling valve 90 can be a check valve (i.e., one-way valve) having a ball and a seat. For its part, the standing valve 70 disposed in the barrel 60 can also be a check valve having a ball and a seat.

As the surface pumping unit 22 in FIG. 1 reciprocates, the rod string 24 reciprocates in the production tubing 30 and moves the plunger 80. The plunger 80 moves the traveling valve 90 in reciprocating upstrokes and downstroke. During an upstroke, the traveling valve 90 is closed. Movement of the closed traveling valve 90 upward reduces the static pressure within the pump chamber 62 (the volume between the standing valve 70 and the traveling valve 90 that serves as a path of fluid transfer during the pumping operation). This, in turn, causes the standing valve 70 to open so that the lower ball lifts off the lower seat. Production fluid F is then drawn upward into the chamber 62.

On the following downstroke, the standing valve 70 closes as the standing ball seats upon the lower seat. At the same time, the traveling valve 90 opens so fluids previously residing in the chamber 62 can pass through the valve 90 and into the interior of the plunger 80. Ultimately, the produced fluid F is delivered by positive displacement of the plunger 80, out passages in the barrel 60. The moved fluid then moves up the wellbore 10 through the tubing 30. The upstroke and down stroke cycles are repeated, causing fluids to be lifted upward through the wellbore 10 and ultimately to the earth's surface.

The conventional rod pump 50 holds pressure during a pumping cycle by using sliding mechanical seals and/or a hydrodynamic seal between the plunger's outside diameter and the barrel's inside diameter. Sand in the production fluid F and during frac flowback can damage the surfaces of the plunger 80 and barrel 60. In particular, the plunger 80 may reciprocate inside the barrel 60 utilizing a small annular clearance (approximately 0.002-in. radial) in order to form an effective hydrodynamic seal. This small clearance also allows a small amount of lubricating fluid (typically called "slippage fluid") to pass in the annulus between the plunger 80 and barrel 60 in order to reduce friction and adhesive wear. The differential pressure across the sealing area causes fluid to migrate past the area.

When this migrating fluid contains sand or other particulates, the surfaces of the plunger 80 and barrel 60 can become abraded so the assembly eventually becomes less capable of holding pressure. Overtime, significant amounts of sand can collect between the plunger 80 and the barrel 60, causing the plunger 80 to become stuck within the barrel 60.

Production operations typically avoid using such a rod pump 50 in wellbores having sandy fluids due to the damage that can result. However, rod pumping in sandy fluids has been a goal of producers and lift equipment suppliers for some time. To prevent sand damage, inlet screens can be disposed downhole from the pump 50 to keep sand from entering the pump 50 altogether. Yet, in some applications, using an inlet screen in such a location may not be feasible, and the inlet screen and the rathole below can become fouled with sand. In other applications, it may actually be desirable to produce the sand to the surface instead of keeping it out of the pump 50.

In one technique to deal with particulate migration and to maintain the clearance with the barrel 60, the downhole pump 50 uses a soft packed plunger 80 having wiper rings that swell up in downhole fluids to tighten the plunger's fit in the barrel 60. Such wiper rings, commonly referred to as Martin-style composition rings, are currently manufactured using a combination of natural or synthetic rubber combined with a duck material. For example, cotton duck and neoprene are often used for the wiper rings. Unfortunately, these materials are limited to use in about 200-F downhole temperatures, and they are susceptible to degradation in the presence of $CO_2$. Overtime, such conventional wiper rings degrade and fail, eliminating their effective purpose.

The subject matter of the present disclosure is directed to overcoming, or at least reducing the effects of, one or more of the problems set forth above.

SUMMARY OF THE DISCLOSURE

According to the present disclosure, a downhole pump is used for a reciprocating pump system having a rod string disposed in a tubing string. The pump comprises a barrel, a plunger, and one or more wipers. The barrel is disposed in the tubing string and has an internal surface. The plunger is coupled to the rod string and is movably disposed in the barrel. The plunger has an external surface disposed at an annular clearance relative to the internal surface. The external surface has one or more circumferential grooves defined thereabout.

The one or more wipers are disposed in the one or more circumferential grooves on the external surface of the plunger. Each of the one or more wipers comprises: an inner ring composed of a swellable material and engaged in the one or more circumferential grooves, and an outer ring composed of a second material and disposed about the inner ring. The swellable material of the inner ring energizes the outer ring across the annular clearance into slideable engagement with the internal surface of the barrel.

The swellable material can be selected from the group consisting of elastomer, ethylene propylene diene M-class rubber (EPDM), ethylene propylene copolymer (EPM) rubber, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber, polynorbornene, nitrile, fluoroelastomer, fluoropolymer, and perfluoroelastomer.

The second material can be selected from the group consisting of a composite of a fiber and a binder; a composition of duck material and rubber; a composite of a para-aramid synthetic fiber and nitrile rubber; a composition of polyester and nitrile rubber; a composition of nylon and nitrile rubber; a thermoplastic; a polytetrafluoroethylene (PTFE); or a combination thereof. The second material can be comprised of a homogenous thermoplastic.

The barrel can comprise a standing valve controlling flow of fluid into a barrel chamber defined by the internal surface, and the plunger can comprise a traveling valve controlling flow of fluid into a plunger chamber inside the plunger.

The plunger can define a plunger chamber therein communicating through at least one side port of the plunger with the annular clearance. The plunger can further comprise a filter disposed on the plunger adjacent the at least one side port.

The pump can further comprise one or more unitary composition rings disposed in one or more others of the circumferential grooves on the external surface of the plunger.

The inner ring can comprise a split or full ring installed in the circumferential groove. Alternatively, the inner ring can comprise the swellable material formed in the circumferential groove. For its part, the outer ring can comprise a split of full ring installed in the circumferential groove over the inner ring.

According to the present disclosure, a plunger is used for a downhole pump of a reciprocating pump system having a rod string disposed in a tubing string. The plunger couples to the rod string and is movably disposed in a barrel of the pump. The plunger comprises an external surface disposed at an annular clearance relative to an internal surface of the barrel. The external surface has one or more circumferential grooves defined thereabout.

The plunger comprises one or more wipers disposed in the one or more circumferential grooves on the external surface of the plunger. Each of the one or more wipers comprises an inner ring composed of a swellable material and engaged in the one or more circumferential grooves, and an outer ring composed of a composite material and disposed about the inner ring. The swellable material of the inner ring energizes the outer ring across the annular clearance into slideable engagement with the internal surface of the barrel. The plunger may further comprise any of the other features discussed above.

According to the present disclosure, a method of assembling a downhole pump of a reciprocating pump system comprises: positioning one or more inner rings of a swellable material in one or more circumferential grooves defined in an external surface of a plunger of the downhole pump; positioning one or more outer rings of a second material about the one or more inner rings; and positioning the plunger inside a barrel of the downhole pump.

Positioning the one or more inner rings in the one or more circumferential grooves can comprise filling the one or more circumferential grooves with the swellable material forming the one or more inner rings; or fitting the one or more inner rings as split or full rings inside the one or more circumferential grooves.

Positioning the one or more outer rings about the one or more inner rings can comprise fitting the one or more outer rings as split or full rings about the one or more inner rings; or installing the one or more inner rings and the one or more outer rings as a unit in the one or more circumferential grooves.

The method can further comprise coupling a screen assembly on the plunger below a mandrel of the plunger having the one or more circumferential grooves; and/or coupling the plunger to a pump rod; and coupling the pump rod to a rod string of the reciprocating pump system.

The foregoing summary is not intended to summarize each potential embodiment or every aspect of the present disclosure.

DETAILED DESCRIPTION OF THE DISCLOSURE

Figure 2:
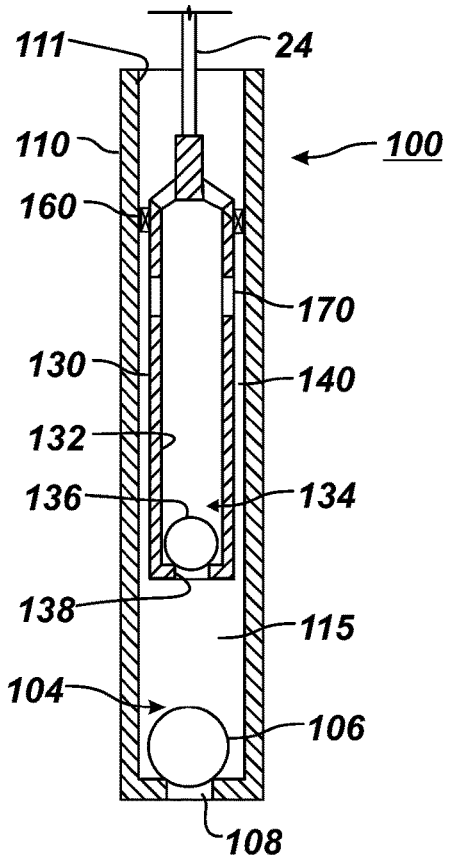
FIG. 2 illustrates a schematic cross-sectional view of a rod pump of the present disclosure.

FIG. 2 illustrates a subsurface rod pump 100 of the present disclosure having a barrel 110 with a plunger 130 movably disposed therein. The barrel 110 has a standing valve 104, and the plunger 130 is attached to the rod string 24 and has a traveling valve 134. For example, the traveling valve 134 can be a check valve (i.e., one-way valve) having a ball 136 and seat 138. For its part, the standing valve 104 for the barrel 110 can also be a check valve having a ball 106 and seat 108.

As a surface pumping unit (such as in FIG. 1A) operates, the rod string 24 reciprocates in the plunger 130 in the barrel 110. The plunger 130 moves the traveling valve 134 in reciprocating upstrokes and downstroke. During an upstroke, the traveling valve 134 as shown in FIG. 2 is closed (i.e., the upper ball 136 seats on upper seat 138). Movement of the closed traveling valve 134 upward reduces the static pressure within the pump chamber 115 (the volume between the standing valve 104 and the traveling valve 134 that serves as a path of fluid transfer during the pumping operation). This, in turn, causes the standing valve 104 to unseat so that the lower ball 106 lifts off the lower seat 108. Production fluid is then drawn upward into the chamber 115.

Figure 1:
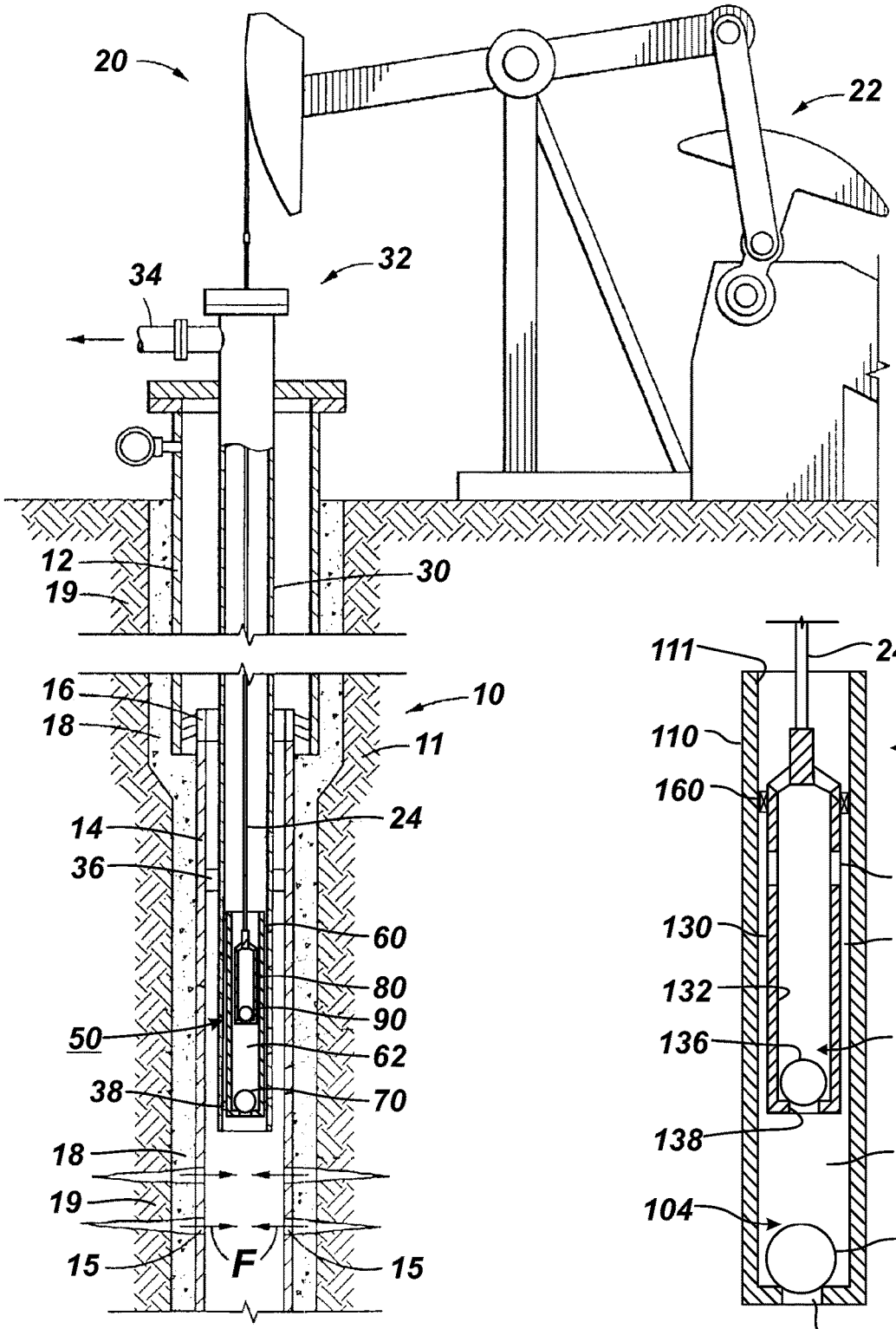
FIG. 1 (Prior Art)
FIG. 1 illustrates a reciprocating rod lift system having a rod pump according to the prior art.

On the following downstroke, the standing valve 104 closes as the standing ball 106 seats upon the lower seat 108. At the same time, the traveling valve 134 opens so fluids previously residing in the chamber 115 can pass through the valve 134 and into the interior 132 of the plunger 130. Ultimately, the produced fluid is delivered by positive displacement of the plunger 130, out passages 111 in the barrel 110. The moved fluid then moves up a wellbore through tubing (as shown in the system of FIG. 1). The upstroke and down stroke cycles are repeated, causing fluids to be lifted upward through the wellbore and ultimately to the earth's surface.

The rod pump 100 holds pressure during a pumping cycle by using a hydrodynamic seal 140 in the annular clearance between the plunger's outside diameter and the barrel's inside diameter. In the presence of sandy fluid, this annular clearance can be compromised due to damage, allowing a greater amount of slippage fluid to pass and decreasing pump efficiency. To effectively maintain this small annular clearance while operating in the presence of sandy production fluid, the downhole pump 100 can utilize a bypass port with a screen 170 on the plunger 130 to filter out sand from the slippage fluid. The screen 170 is used in conjunction with one or more wipers 160 that prevent the sand from entering the annular clearance between the working plunger 130 and the barrel 110. Due to the location of the screen 170, there is no pressure differential across the wipers 160 so they are essentially acting as wiping members and not sealing members.

These one or more wipers 160 are configured to meet the gravity of the fluids being produced and the bottom hole temperature of the well. The one or more wipers 160 also allow the plunger 130 to be used for sandy conditions in which particulates in the wellbore fluids are being produced. Details of the one or more wipers 160 are now discussed with reference to FIGS. 3A-3B.

Figure 3A:
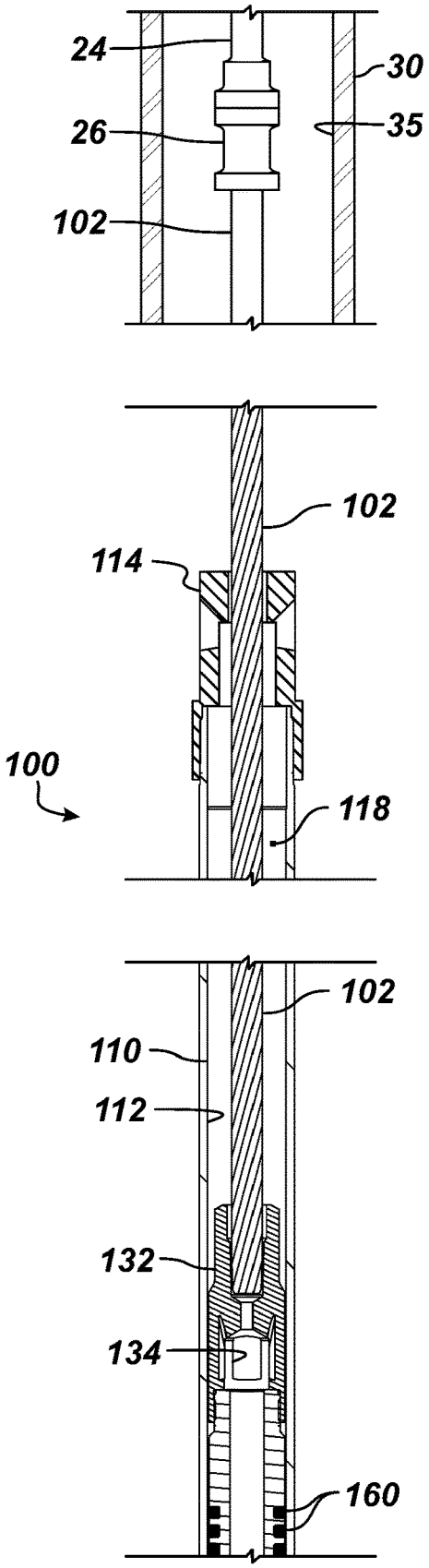
FIGS. 3A-3B illustrate detailed portions of a rod pump according to the present disclosure.
Figure 3B:
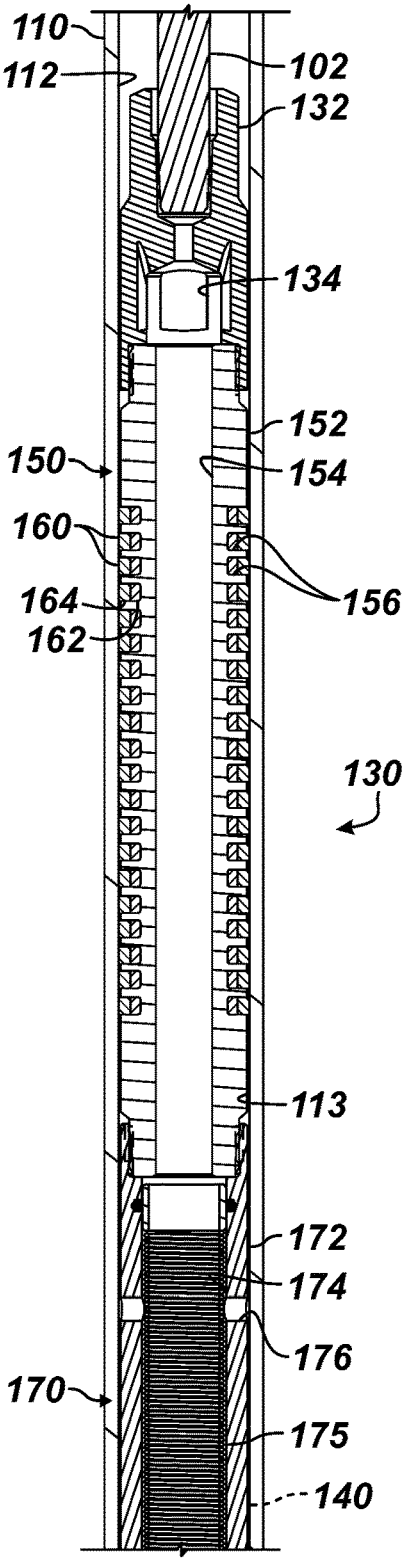

FIGS. 3A-3B illustrate upper portions of the subsurface rod pump 100 of the present disclosure in more detail. As only partially shown in FIG. 3A, the pump 100 installs downhole in production tubing 30 in a wellbore. Surrounding casing of the wellbore and other features are not shown in FIGS. 3A-3B.

As shown in FIG. 3A, the reciprocating rod string 24 connects by a coupling 26 to a pump rod 102, which runs through the pump's outlet 114 and into the pump's barrel 110. The pump rod 102 extends through the barrel 110 and connects to the plunger 130 at its proximal end 132.

At its downhole end, the barrel 110 has a standing valve (not shown)—not unlike that used on the pump 100 of FIG. 2, permitting fluid passage into the barrel's bore 112 and restricting fluid passage out of the barrel's bore 112. The barrel's downhole end at the pump's inlet is fixed in the tubing 30 in any number of available ways, such as with a seating nipple (not shown) or other component as conventionally done.

The plunger 130 is reciprocally disposed in the barrel 110. As shown in the further detail of FIG. 3B, the plunger 130 forms a hydrodynamic seal 140 in an annular sealing region or clearance 113 with the barrel 110. The plunger 130 further includes a traveling valve (not shown)—not unlike that used in the pump 100 of FIG. 2, and includes other conventional components.

The proximal end 132 of the plunger 130 has fluid passages 134 for fluid in the plunger 130 to exit into the barrel 110 uphole of the hydrodynamic seal 140. In turn and as shown in FIG. 3A, the outlet 114 of the barrel 110 has a central passage for the pump rod 102 and has fluid pathways for communicating fluid from the barrel 110 to the tubing 30.

As noted above and as best shown in FIG. 3B, the hydrodynamic seal 140 is formed by the fluid slippage in the annular sealing region or clearance 113 between the plunger 130 and the barrel's bore 112. To prevent particulate from entering the region 113 at the uphole end of the plunger 130, the plunger 130 has a series of wipers 160 disposed in circumferential grooves 156 thereabout to engage inside the barrel 110.

For example, the plunger 130 can include a wiper mandrel 150 at its upper end that couples by the coupler 132 to the rod 102. In its external surface 152, the wiper mandrel 150 has a series of circumferential grooves 156 that hold the wipers 160, which can prevent particulate from entering the annular sealing region 113 between the working plunger 130 and the barrel 110.

As noted previously with respect to claim 2, the plunger 130 in some implementations can use a screen in conjunction with the wipers 160. Therefore, as shown in FIG. 3B, the plunger 130 includes a screen assembly 170 using in conjunction with the grooved wiper mandrel 150 having the wipers 160. In other implementations, the plunger 130 may not use such a screen assembly 170, and may instead use the wipers 160 alone.

For its part, the screen assembly 170 filters out sand and other particulate from the slippage fluid communicated from inside the plunger 130 into the annular region 113 to form the hydrodynamic seal 140. As shown in FIG. 3B, the screen assembly 170 has one or more leakage or equalization ports 176 communicating an inner bore 174 with an exterior surface 172 of the plunger's assembly 170 where the slippage fluid for the hydrodynamic seal 140 is located.

A screen filter 175 disposed in the bore 174 prevents the particulate in the produced fluid inside the plunger 130 from passing into the annular region 113. In this way, the screen filter 175 separating the interior of the plunger 130 from the annulus between the plunger 130 and the barrel 110 can filter fluid in the plunger's interior before it can pass to the annular region 113 as slippage fluid. Due to the location of the screen filter 175, there is essentially no pressure differential across the wipers 160 so that the wiper 160 act as wiping members and not sealing members.

In contrast to a conventional combination of neoprene and cotton duck used for conventional Martin-style composition rings, the present wipers 160 include an inner ring 162 composed of a first material, and include an outer ring 164 composed of a second material. The outer ring 164 withstands abrasion, while the inner ring 162 energizes the outer ring 164 against the barrel's inner bore 112 to create an essentially "zero-clearance" wiping barrier.

Figure 4A:
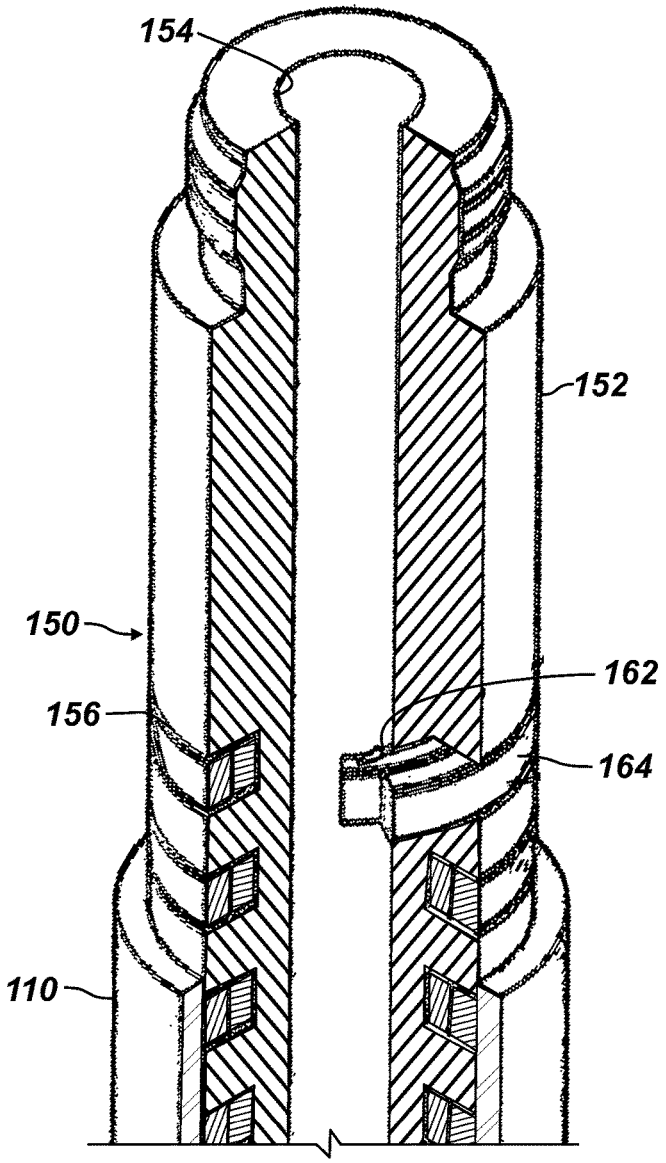
FIG. 4A illustrates a cutaway, perspective view of a wiper mandrel, wipers, and portion of the barrel for the disclosed rod pump.
Figure 4B:
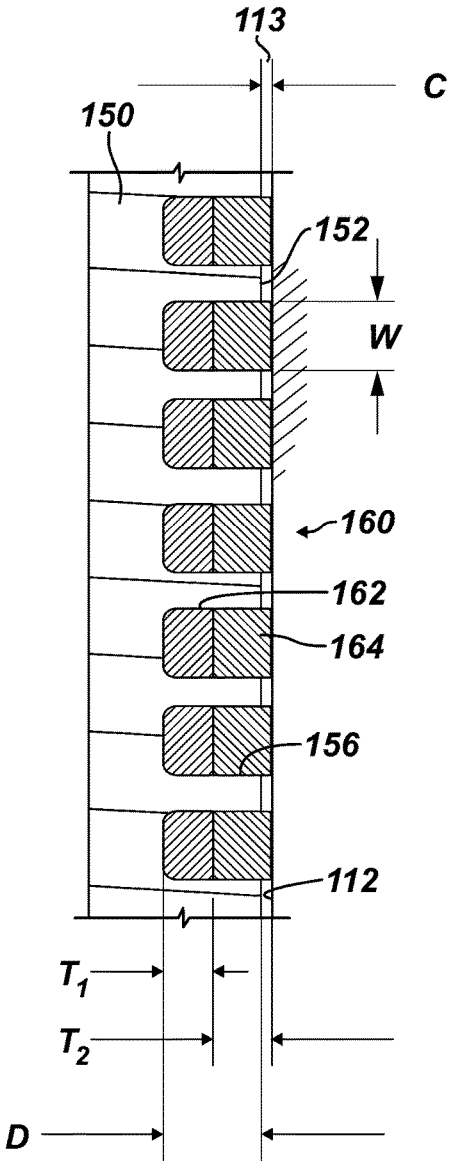
FIG. 4B illustrates a detailed cross-sectional view of the wiper mandrel and wipers of the present disclosure.

Turning to FIGS. 4A-4B, the wipers 160 in the circumferential grooves 156 of the wiper mandrel 150 are depicted in greater detail. Again, the wipers 160 disposed in the circumferential grooves 156 include the inner ring 162 engaged in the one or more circumferential grooves 156 and include the outer ring 164 disposed about the inner ring 162.

The inner ring 162 is composed of a swellable material configured to swell in the presence of well fluid. As it swells, the swellable material of the inner ring 162 energizes the outer ring 164 into slideable engagement with the internal surface 112 of the barrel 110. As shown in FIG. 4B, for example, the inner ring 162 engaged in the groove 156 has a first thickness $T_1$, which is variable due to the swellable properties of the swellable material. The outer ring 164 has a second thickness $T_2$, which may vary due to abrasion or other degradation. The two rings 162, 164 are disposed in the groove 156 having a slot depth D and width W.

The swellable inner ring 162 expands or swells during use (i.e., increases in thickness $T_1$) and pushes the outer ring 164 outward from the mandrel 150 into the annular region 113 between the mandrel 150 and the barrel's bore 112. During use, the second thickness $T_2$ of the outer ring 164 may decrease due to abrasive effects or the like, yet the swellable inner ring 162 can continue to push the outer ring 164 across the clearance C and to keep the outer ring 164 in "zero-clearance" wiping engagement with the barrel's bore 112.

The inner and outer rings 162, 164 of the wipers 160 can be configured for various implementations, downhole conditions, and the like. Depending on the implementation, one or more wipers 160 may be used on the mandrel 150. In some implementations, several dozens of the wipers 160 may be installed on the mandrel 150, such as depicted here in FIGS. 3A-4B. Each of these wipers 160, or at least some of them, can comprises the inner and outer rings 162, 164 as disclosed herein. Other wipers on the plunger can use conventional Martin-style composition rings, such as those composed of cotton duck and neoprene.

At the time of installation, both rings 162, 164 of the wiper 160 can have the same or different thicknesses $T_1$ and $T_2$, which may be selected for the particular slot depth D of the groove 156 and the clearance C of the region 113. Similarly, both rings 162, 164 of the wiper 160 can have the same or different width, which may be selected for the particular width W of the groove 156. The grooves 156 can have a configured spacings from one another, and they may have form circumferential slots with rectilinear sidewalls, although other shapes could be used.

The wipers 160 are configured to perform particular functions. For example, the wipers 160 can be configured to withstand temperatures above 225-F, and preferably temperatures up to approximately 350-F. The wipers 160 can also be configured to withstand the presence of $CO_2$ in the wellbore fluid. Finally, the wipers 160 can preferably be abrasion resistant and able to swell approximately 15-20% allowing for an essentially "zero-clearance" wiping barrier.

The two rings 162, 164 are radially nested to perform the desired functions. The outer ring 164 (in sliding contact with the barrel's bore 112) has properties needed for wear resistance, temperature resistance, and chemical resistance. The inner ring 164 has swell properties (along with chemical and temperature resistance) needed for the application at hand. The inner ring 164 effectively energizes the outer ring 162, maintaining pressure against the barrel's bore 112. The outer ring 164 can be sacrificial in nature, as the inner ring 162 with its swelling properties can continue to energize the outer ring 164 into wiper engagement with the barrel's inner surface.

The inner ring 162 is composed of a suitable type of swellable material that may be expandable by about 25% or greater from its original volume. The swellable inner ring 162 can swell in the presence of an activation agent, such as water, oil, production fluid, etc. Any of the swellable materials known and used in downhole applications can be used for the inner ring 162. For example, the swellable material can be elastomer, ethylene propylene diene M-class rubber (EPDM), ethylene propylene copolymer (EPM) rubber, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber, polynorbornene, nitrile, fluoroelastomer, fluoropolymer, and perfluoroelastomer. The swellable material of the inner ring 162 may or may not be encased in another expandable material that is porous or has holes. It is even contemplated that the inner ring 162 can be a composition of duck material and swellable material.

The second material of the outer ring 164 can include: a composition of a fiber and a binder; a composition of a duck material and a rubber; a composition of a para-aramid synthetic fiber and nitrile rubber; a composition of polyester and nitrile rubber; a composition of nylon and nitrile rubber; a thermoplastic; a homogenous thermoplastic; a polytetrafluoroethylene (PTFE); or any other material or combination thereof suitable as an effective wiping member.

Figure 5:
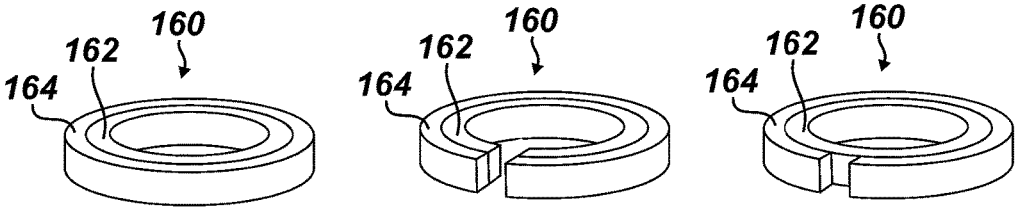
FIG. 5 illustrates various arrangements of the wipers of the present disclosure.

As shown in FIG. 5, the various inner and outer rings 162, 164 can be split rings, full rings, or a combination of these depending on the assembly and how the rings 162, 164 can be disposed on the mandrel 150. The swellable inner ring 162 can be pre-formed and installed in the groove (156). Therefore, the swellable ring 162 may be a split ring or a solid ring—flexible enough to allow for its insertion in the groove (156). Alternatively, the inner ring 162 may be formed of the swellable material applied directly within the groove (156).

The outer ring 164 can be a split ring that is opened to fit in the circumferential groove (156) over the inner ring 162, or it too can be a solid ring—flexible enough to allow for its insertion in the groove (156). The splits in the two rings 162, 164 can be aligned or offset from one another.

Instead of separate installation of the inner ring 162 followed by the outer ring 164 into the groove (156), the two rings 162, 164 can be formed and assembled together for installation as a single unit into the groove (156). The two rings 162, 164 may also be bonded together as a single unitary piece to allow for easier assembly. These and other assembly and installation steps can be used. In fact, the rings 162, 164 can be mounted on a thinner cylindrical mandrel 150 and a plurality of spacer rings can be disposed between the wipers 160 to form the separated grooves 156 of the assembly.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole pump to pump sandy fluid having particulate for a reciprocating pump system having a rod string disposed in a tubing string, the pump comprising:

a barrel disposed in the tubing string and having an internal surface;

a plunger coupled to the rod string and movably disposed in the barrel, the plunger having an external surface disposed at an annular clearance relative to the internal surface, the external surface having a plurality of circumferential grooves defined thereabout; and a plurality of wipers each disposed in a respective one of the plurality of circumferential grooves on the external surface of the plunger, each of the wipers comprising:

an inner ring composed of a swellable material and engaged in the respective circumferential groove, the inner ring having first inner and outer surfaces, and an outer ring composed of a second material and having second inner and outer surfaces, the second inner surface disposed about the first outer surface of the inner ring, the swellable material of the inner ring being configured to energize the second outer surface of the outer ring radially outward from the groove, across the annular clearance, and into slidable engagement with the internal surface of the barrel, the second outer surface of the outer ring energized into the slidable engagement being configured to wipe the internal surface of the barrel and prevent the particulate in an uphole region of the barrel from entering the annular clearance.

2. The pump of claim 1, wherein the swellable material is selected from the group consisting of elastomer, ethylene propylene diene M-class rubber (EPDM), ethylene propylene copolymer (EPM) rubber, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber, polynorbornene, nitrile, fluoroelastomer, fluoropolymer, and perfluoroelastomer.

3. The pump of claim 1, wherein the second material is selected from the group consisting of a composite of a fiber and a binder; a composition of duck material and rubber; a composite of a para-aramid synthetic fiber and nitrile rubber; a composition of polyester and nitrile rubber; a composition of nylon and nitrile rubber; a thermoplastic; a homogenous thermoplastic; a polytetrafluoroethylene (PTFE); or a combination thereof.

4. The pump of claim 1, wherein the barrel comprises a standing valve controlling flow of fluid into a barrel chamber defined by the internal surface.

5. The pump of claim 1, wherein the plunger comprises a traveling valve controlling flow of fluid into a plunger chamber inside the plunger.

6. The pump of claim 1, wherein the plunger defines a plunger chamber therein communicating through at least one side port of the plunger with the annular clearance.

7. The pump of claim 6, wherein the plunger further comprises a filter disposed on the plunger adjacent the at least one side port.

8. The pump of claim 1, further comprising one or more unitary composition rings disposed in one or more of the plurality of the circumferential grooves on the external surface of the plunger.

9. The pump of claim 1, wherein the inner ring comprises a split or full ring installed in the respective one of the plurality of the circumferential grooves.

10. The pump of claim 1, wherein the inner ring comprises the swellable material formed in the respective one of the plurality of the circumferential grooves.

11. The pump of claim 1, wherein the outer ring comprises a split ring or a full ring installed in the respective one of the plurality of the circumferential grooves over the inner ring.

12. A plunger to pump sandy fluid having particulate for a downhole pump of a reciprocating pump system having a rod string disposed in a tubing string, the plunger coupling to the rod string and movably disposed in a barrel of the pump, the plunger comprising:

an external surface disposed at an annular clearance relative to an internal surface of the barrel, the external surface having a plurality of circumferential grooves defined thereabout; and a plurality of wipers each disposed in a respective one of the circumferential grooves on the external surface of the plunger, each of the wipers comprising:

an inner ring composed of a swellable material and engaged in the respective circumferential groove, the inner ring having first inner and outer surfaces, and an outer ring composed of a composite material and having second inner and outer surfaces, the second inner surface disposed about the first outer surface of the inner ring, the swellable material of the inner ring being configured to energize the second outer surface of the outer ring radially outward across the annular clearance and into slidable engagement with the internal surface of the barrel, the second outer surface of the outer ring energized into the slidable engagement being configured to wipe the internal surface of the barrel and prevent the particulate in an uphole region of the barrel from entering the annular clearance.

13. A method of assembling a downhole pump of a reciprocating pump system to pump sandy fluid having particulate, the method comprising:

positioning inner rings of a swellable material in circumferential grooves defined in an external surface of a plunger of the downhole pump, the inner ring having first inner and outer surfaces;

positioning outer rings of a second material about the inner rings, the outer rings having second inner and outer surfaces, the second inner surface disposed about the first outer surface of the inner ring;

positioning the plunger inside a barrel of the downhole pump with an annular clearance between an internal surface of the barrel and the external surface of the plunger; and allowing the swellable material of the inner rings to energize the second outer surface of the outer ring radially outward across the annular clearance and into slidable engagement with the internal surface of the barrel, to thereby wipe the internal surface of the barrel and prevent the particulate in an uphole region of the barrel from entering the annular clearance.

14. The method of claim 13, wherein positioning the inner rings in the circumferential grooves comprises filling the circumferential grooves with the swellable material forming the inner rings.

15. The method of claim 13, wherein positioning the inner rings in the circumferential grooves comprises fitting the inner rings as split or full rings inside the circumferential grooves.

16. The method of claim 13, wherein positioning the outer rings about the inner rings comprises fitting the outer rings as split or full rings about the inner rings.

17. The method of claim 13, wherein positioning the inner rings and the outer rings comprises installing the inner rings and the outer rings as a unit in the circumferential grooves.

18. The method of claim 13, further comprising coupling a screen assembly on the plunger below a mandrel of the plunger having the circumferential grooves.

19. The method of claim 13, further comprising coupling the plunger to a pump rod; and coupling the pump rod to a rod string of the reciprocating pump system.

* * * * *